United States Patent [19]

Vives

[11] 4,349,694

[45] Sep. 14, 1982

[54] SUB-MARINE TELEPHONE CABLE

[75] Inventor: Jean-Patrick Vives, Calais, France

[73] Assignee: Les Cables de Lyon, Lyons, France

[21] Appl. No.: 931,392

[22] Filed: Aug. 4, 1978

Related U.S. Application Data

[63] Continuation-in-part of Ser. No. 796,813, May 13, 1977, abandoned.

[30] Foreign Application Priority Data

May 25, 1976 [FR] France ..... 76 15788

[51] Int. Cl.[3] ..... H01B 5/10

[52] U.S. Cl. ..... 174/128 R; 57/214; 57/230; 174/130

[58] Field of Search ..... 174/128 R, 130; 57/213, 57/214, 215, 230, 235

[56] References Cited

U.S. PATENT DOCUMENTS

| | | | |
|---|---|---|---|
| 1,373,632 | 4/1921 | Phelps | 57/213 |
| 2,098,163 | 11/1937 | Reed | 174/128 R |
| 2,212,700 | 8/1940 | Peterson | 57/213 X |
| 3,328,874 | 7/1967 | Davis | 174/106 X |
| 3,339,012 | 8/1967 | Hutchins | 174/128 R |
| 3,647,939 | 3/1972 | Schoerner | 174/130 X |

FOREIGN PATENT DOCUMENTS

| | | | |
|---|---|---|---|
| 1477940 | 12/1975 | United Kingdom | 174/130 |

*Primary Examiner*—Richard R. Kucia

*Attorney, Agent, or Firm*—Sughrue, Mion, Zinn, Macpeak & Seas

[57] ABSTRACT

The coaxial sub-marine telephone cable employs a central conductor which is formed by a compound twisted core of high tensile steel wires and of aluminum-based wires which are encased in a longitudinally welded copper tube that is applied tightly around the twisted core. The aluminum-based wire has high tensile strength, high breaking elongation and good electrical conductivity. The crushing of the aluminum based wires by the steel wires under the effect of radial pressures exerting on the core through sizing dyes while being manufactured is minimized and avoided by arranging the steel wires in contact with each other under radial compression so that they interact as an arch or vault.

4 Claims, 3 Drawing Figures

SUB-MARINE TELEPHONE CABLE

The present application is a continuation-in-part application of my co-pending application Ser. No. 796,813 entitled A Submarine Telephone Cable, filed May 13, 1977 now abandoned.

FIELD OF THE INVENTION

The present invention relates to a coaxial sub-marine telephone cable and in particular to the central core of such a cable.

BACKGROUND OF THE INVENTION

Portions of coaxial telephone cables laid at great depths are constituted by a central twisted core made of wires of hard high tensile steel, a copper tube welded longitudinally and tightly applied about the core to constitute the inner conductor of the coaxial cable, a dielectric layer which is extruded and centred, a metal tube tightly fitted about the dielectic layer to constitute the outer conductor of the coaxial cable and lastly a plastics sheath extruded onto the outer conductor.

Such a cable which is laid at great depths, includes no other element such as an outer armour for example and must therefore withstand high stresses, by means of the central core of high-tensile steel, as for example, when it is lifted.

The strength of the core must be sufficient to lift the cable when it is laid at great depth; the maximum length of cable suspended in the water before the top end breaks is called the modulus. It is expressed by the formula:

Modulus = Breaking strength (tonnes)/Weight in water (tonnes per nautical mile)

The DC electrical resistance is a fundamental parameter of long-distance connections. Indeed, the AC electric equipments strung out along the cable are fed in series from the terminal stations with DC by the central conductor. High ohmic voltage drops in the line could lead to feed voltages at the terminal stations which would be too high for the system to be reliable.

The compound (steel-copper) central conductor is manufactured in a single operation by a machine constituted mainly by:

a linear twisting machine,
a tube forming machine,
a welding unit,
a tightening unit.

All these elements are placed in line and operate in synchronism.

Twisting machine:

A tube contains as many bobbins as there are wires to be assembled, suspended about its axis of rotation and of symmetry. Said bobbins unwind, turning only round their own axis of rotation. The tube rotates at a speed proportional to the pulling speed of the core. The wires are guided along the walls of the tube and at its end by ramps or guides made of metal or a ceramic substance. Their paths then converge at the end of the tube towards a die whose size governs the diameter of the core and the continuity of its pitch. The wires are generally braked by small cords rubbing on a groove on the cheek of each bobbin.

Tube forming machine:

Motor-driven rollers whose speed is proportional to the pulling speed form the tube round the core from a sheet which has previously been cut to the exact width.

Welding unit:

The lips of the tube are welded lengthwise by a conventional inert gas arc welding method.

Tightening unit:

The inside diameter of the welded tube is firstly reduced to a diameter close to that of the core, by a reduction in its cross-section without any reduction in its thickness, by means of motor-driven rollers whose speed is proportional to the pulling speed.

Then, the drawn down tube and the core are forced through a tungsten carbide tightening die, which causes a penetration of the copper between the wires and which calibrates the diameter of the inner conductor.

It was also proposed in U.S. Pat. No. 3,834,149 to assemble the steel wires of a wire rope with wires or a foil of aluminium or zinc, in order to protect the steel wires against corrosion.

SUMMARY OF THE INVENTION

According to the present invention, a central conductor for a coaxial telephone cable comprises a compound twisted core of high-tensile steel wires and of aluminium-based wires encased in a longitudinally welded copper tube which is applied tightly around the twisted core, wherein the aluminium-based wire has high tensile strength, high breaking elongation and good electrical conductivity and wherein crushing of the aluminium-based wires by the steel wires under the effect of the radial pressures exerted on the core by sizing dies through which it passes during manufacture is avoided so arranging the steel wires in contact with each other that under radial compression they interact as an arch or vault which withstands the applied compression.

To that effect, the core comprises from its axis to its periphery:

(a) an axial wire of aluminium-based metal of a relatively large diameter, said aluminium-based wire having a high tensile strength, a high breaking elongation and a good electrical conductivity, (b) an inner layer of high-tensile steel wires of the same diameter, lesser than that of said axial wire (c) an intermediate layer of alternated high-tensile steel and aluminium-based wires, (d) an outer layer of high-tensile steel wires of the same diameter, said steel wires being so interrelated that any steel wire of said intermediate layer is in contact with a steel wire of said inner layer and with two adjacent steel wires of said outer layer and forms therewith a $\gamma$ configuration, any group of two adjacent $\gamma$ configurations leaving between them a void in the intermediate layer in which is located an aluminium-based wire, and the respective diameters of said aluminium-based wires of said intermediate layer and of said steel wires of said intermediate and said outer layer being such that under the effect of the radial pressure exerted on the core by a sizing die during its manufacture any group of two steel wires of said outer layer, in contact with an aluminium-based wire of said intermediate layer come into mutual contact, while any group of two steel wires of said outer layer in contact with a steel wire of said intermediate layer do not come into contact.

Such a design allows to lessen the crushing of the aluminium-based wires under the effect of the radial pressure during the tightening operation, the mutual contact of the steel wires of the inner layer lessening the crushing of the axial wire, and the mutual contact of two adjacent steel wires of the outer layer in contact with an aluminium-based wire of the intermediate layer lessening the crushing of the latter.

Moreover, the presence of the aluminium-based wires increases the DC conductivity of the core, this making it possible to reduce the thickness of the copper without impairing the DC conductivity of the complete inner conductor or the high-frequency conductivity of the inner conductor. The product thus constituted allows substantial reduction of material costs. Moreover, it is easier to repair in case of breakage by enclosing the damaged section in a tightened sleeve.

Further, for a given outer diameter of the inner conductor, a reduction in the thickness of the copper leads to an increase of the diameter of the core. Since it is also not compact and since it contains wires of the aluminium-based metal, its breaking strength decreases very little, while the weigth of the inner conductor decreases noticeably. The modulus is only slightly decreased or is not decreased at all.

Also, since there are only n mutual contacts of adjacent steel wires of an outer layer of 2 n steel wires, the margin on the final diameter of the core, which is a function of the margin on the diameters of the outer steel wires, is only half of that corresponding to a mutual contact of all the outer steel wires with one another.

The aluminium-based metal is to have high mechanical strength and a high breaking elongation and also good conductivity. Preferably it is an aluminium alloy with about 0.6% magnesium and about 0.6% silicon or the 6201 T 81 aluminium alloy. But wires of hard 4/4 aluminium are also suitable. The cables thus constituted is not greatly deformed when the aluminium-based wires are deformed.

DETAILED DESCRIPTION

Figure 1:
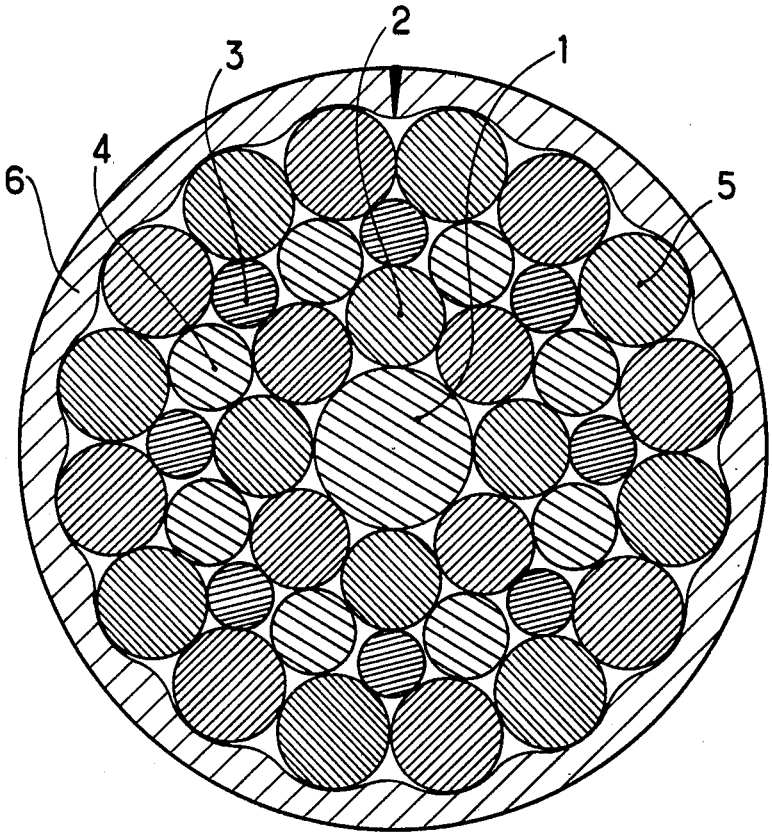
FIG. 1 illustrates a cross-section of a Warrington-type core encased in a longitudinally welded copper tube.
Figure 2:
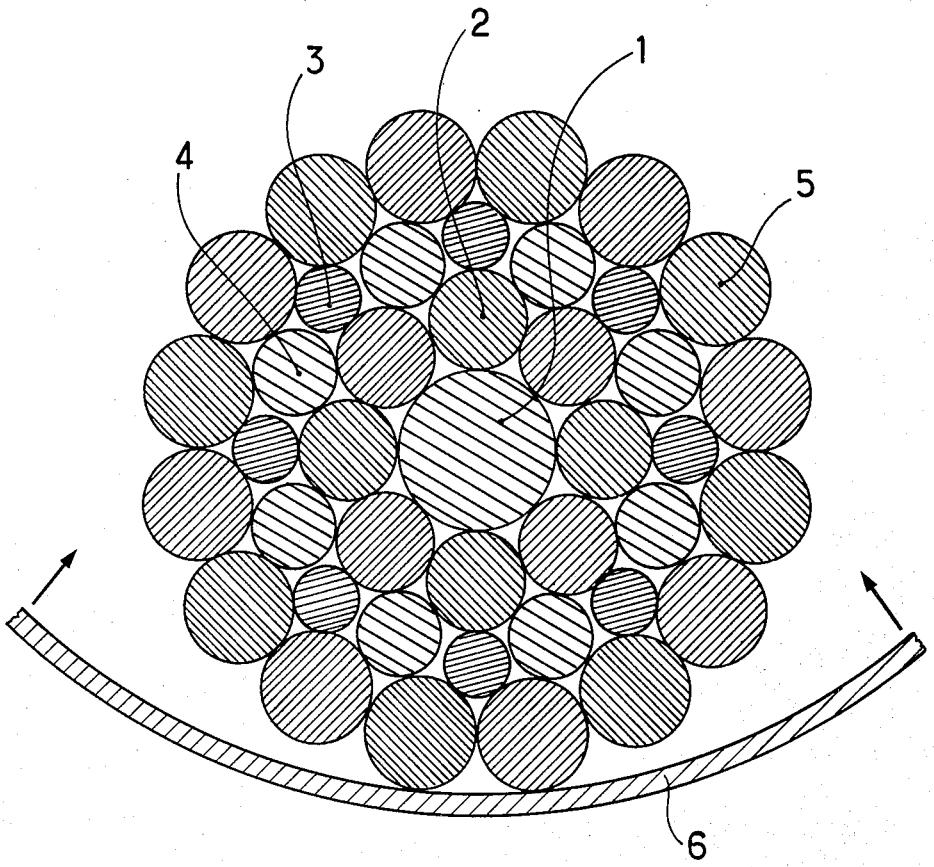
FIG. 2 illustrates the core and part of a copper tape before the latter is wrapped around the core and longitudinally welded.

FIG. 1 is the accompanying drawing gives an example of a cross-section of a Warrington type core. An aluminium alloy central wire 1 is surrounded by a layer of 8 steel wires 2. The following layer comprises 8 small-diameter steel wires 3 and 8 larger aluminium alloy wires 4. Lastly, the outer layer comprises 16 steel wires 5. The core is encased within a longitudinally welded copper tube 6 tightened around it. FIG. 2 shows the core and part of the copper tube before the latter is wrapped around the core, longitudinally welded and tightened around the core. It is apparent that the thickness of the copper sheet is lesser than the thickness of the final copper tube tightened around the core.

With such a disposition, the diameter of the core is not sensitive to irregularities in the hardness of the aluminium alloy wires. Indeed, it is inevitable, due to the considerable pressure in the reducing die, that the steel wires penetrate slightly into the aluminium alloy wires.

To do this, this penetration must be limited by arranging the steel wires in an incompressible assembly in contact with one another. The core whose part of the cross-section is shown in more detail in FIG. 3 fulfills this condition.

Figure 3:
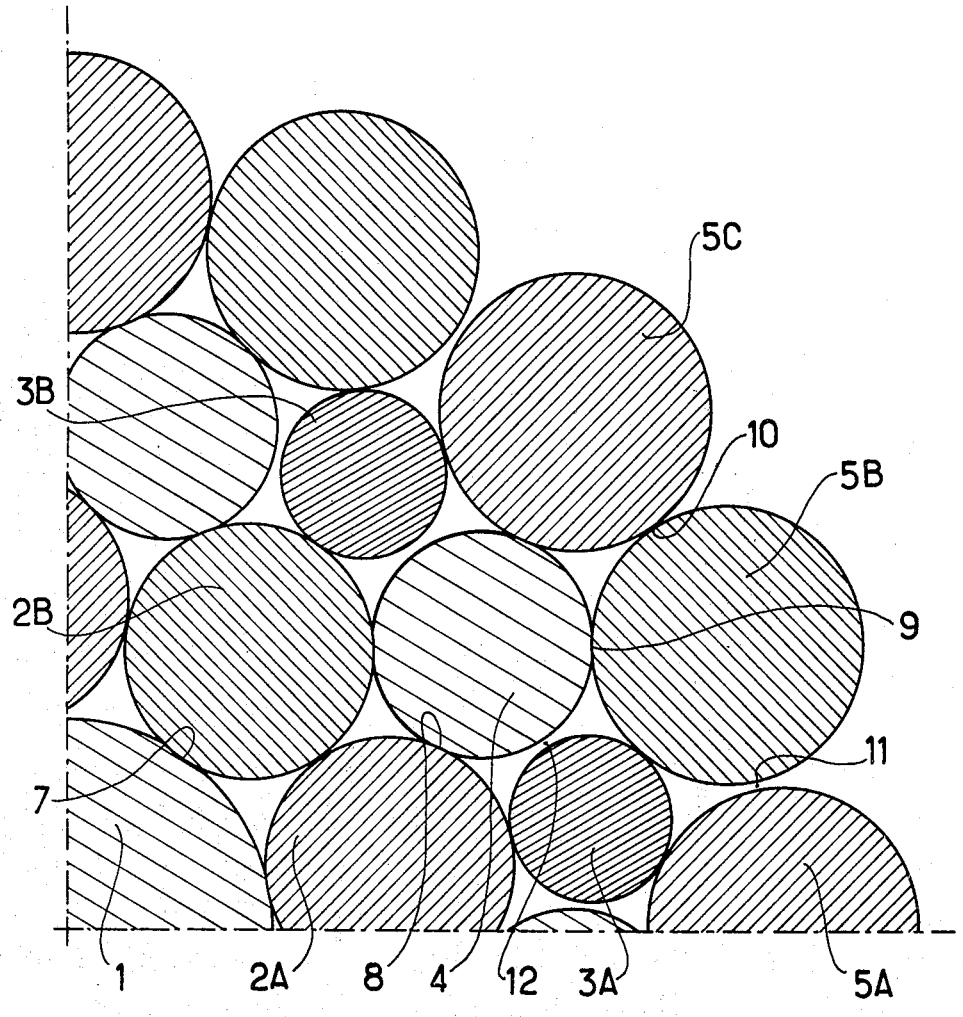
FIG. 3 illustrates the relative positions of the steel wires and the aluminium-based alloy wires after the tightening operation.

In FIG. 3, the axial wire 1 has a diameter of 2.569 mm. The steel wires of the inner layer have a diameter of 1.557 mm. The steel wires of the intermediate layer have a diameter of 1.097 mm and the aluminium-based alloy wires of the same layer a diameter of 1.432 mm. The steel wires of the outer layer have a diameter of 1.747 mm. The steel wires 2A, 2B of the inner layer crush slightly as at 7 the axial wire 1 of aluminium-based alloy by only about 0.015 mm, since the crushing is reduced due to the mutual lateral contact of the steel wires. The steel wires of the inner layer and the steel wires 5B, 5C of the outer layer crush also slightly by about 0.010 mm the aluminium-based alloy wires such as 4 of the intermediate layer as at 8, 9, since the mutual contact of the steel wires 2A, 2B, 3A, 3B, 5B, 5C around any aluminium-based alloy wires such as 4 decreases sustantially the crushing of the latter, and the steel wires form a kind of arch or vault around it. While the steel wires 5B, 5C of the outer layer are in contact at 10, the steel wires 5A, 5B of the outer layer in contact with a steel wire 3A of the intermediate layer leave between them a small clearance of about 0.020 mm at 11. There is also a clearance of about 0.015 mm as at 12 between the adjacent steel and aluminium-based alloys wires of the intermediate layer.

It will be appreciated that the cross-section of the wires, even the steel wires, are not perfect circles, because of their twisting and the radial pressure.

The invention also provided a method of manufacturing such a cable. Generally, the entire central conductor of the cable is made in a single operation. The aluminium alloy wires are twisted at the same time as the steel wires on the same twisting machine of which a predetermined number of bobbins have been provided with aluminium wires.

The first difficulty encountered is the wear of the guide ramps of the twisting machine by the friction of the aluminium alloy wires. Conventional metal or ceramic ramps are abraded very rapidly by the surface alumina of the aluminium alloy wires. The problem can be solved by using pure or composite plastics materials with a low friction coefficient and great hardness.

High-density polyethylene formed at high pressure is suitable for example. To obtain a regular cable diameter and pitch, the diameter of the bore of the die box must be substantially less than the diameter of the resulting twisted core without causing extrusion of the aluminium.

The homogeneity of the compactness of the complete conductor is obtained by adjusting the braking tensions so that each wire undergoes the same elastic elongation during manufacture.

A suitable aluminium alloy includes magnesium and silicon in which the concentration of magnesium is about 0.6% and the concentration of silicon about 0.6%. In this example, the mechanical strength is about 33 $kg/mm^2$, the average breakage elongation is about 7% and the resistivity of the alloy is about 3.3 $\mu\Omega\times cm$ at 20° C. Further, it is advantageous to equip the bobbins with eddy current disc brakes. There is a two-fold advantage in this: firstly, braking is constant and is not proportional to the speed; and secondly, braking can be increased during the stopping phases of the twisting machine to prevent slacking of the wires due to the inertia of the bobbins.

If the copper is too thin, it does not bind well to a tightly compacted core, so the pitch is chosen to be exaggeratedly long to minimize the gyration (twisting) effects during the rest of manufacture and during the laying or lifting of the cable in the water.

Acceptable binding is obtained by controlling the regularity of the average and minimum thickness of the copper (hence of the diameter of the core) and the regularity of the penetration of the copper between the wires.

Further, the outside diameter of the product must be accurately maintained to meet the imperative requirements of the transmission characteristics.

It has also been found that the use of a die with a chrome-plated surface induces lesser compression forces in the core and provides greater regularity of the outside diameter of the product when the compactness of the core varies.

In all cases, the bore of the die must be substantially smaller than the outside diameter of the product.

It has also been found that the best binding was obtained when the thickness of the copper (average in the case of penetration) was increasing from the metal tape 6 shown in FIG. 2 to the finished product shown in FIG. 1.

Besides particular adjustements of the speeds of the tightening rollers, this can be obtained by judiciously choosing the diameter of the core so as to have a small elongation of the copper in the tightening die while maintaining good penetration.

What we claim is:

1. A central conductor for a coaxial telephone cable comprising a compound twisted core of high-tensile steel wires and of aluminium-based wires encased in a longitudinally welded copper tube which is applied tightly around the twisted core, said twisted core comprising, from its axis to its periphery, (a) an axial wire of aluminium-based metal of a relatively large diameter, said aluminium-based wire having a high tensile strength, a high breaking elongation and a good electrical conductivity, (b) an inner layer of high-tensile steel wires of the same diameter, lesser than that of said axial wire, (c) an intermediate layer of alternated high-tensile steel and aluminium-based wires, (d) an outer layer of high-tensile steel wires of the same diameter, said steel wires being so interrelated that any steel wire of said intermediate layer is in contact with a steel wire of said inner layer and with two steel wires of said outer layer and forms therewith a Y configuration, any group of two adjacent Y configurations leaving between them a void in the intermediate layer in which is located an aluminium-based wire, and the respective diameters of said aluminium-based wires of said intermediate layer and of said steel wires of said intermediate and said outer layers being such that under the effect of the radial pressure exerted on the core by a sizing die during its manufacture any group of two steel wires of said outer layer in contact with an aluminium-based wire of said intermediate layer come into mutual contact, while any group of two steel wires of said outer layer in contact with a steel wire of said intermediate layer do not come into mutual contact, thereby lessening the crushing of the aluminium-based wires under the effect of said radial pressure.

2. A central conductor according to claim 1, wherein the aluminium-based wire is of an alloy with a tensile breaking resistance of about 33 $Kg/mm^2$, an average breaking elongation of about 7% and an electric resistivity of about 3.3. $\mu\Omega/cm$ at 20° C.

3. A central conductor according to claim 2, wherein the aluminium-based alloy comprises about 0.6% magnesium and about 0.6% silicon.

4. A central conductor according to claim 1, wherein the inner layer of high-tensile steel conductors is made up of n wires, n being an integer, the intermediate layer is made up of n steel wires of a smaller diameter and n aluminium-based wires of a greater diameter, and the outer layer is made up of 2 n steel wires.

* * * * *